US007753124B1

(12) United States Patent
Penisson

(10) Patent No.: US 7,753,124 B1
(45) Date of Patent: Jul. 13, 2010

(54) AUTONOMOUS MAGNETIC SLEEVE FOR A RISER

(76) Inventor: Dennis J. Penisson, 2265 Highway 182, Raceland, LA (US) 70394

( * ) Notice: Subject to any disclaimer, the term of this patent is extended or adjusted under 35 U.S.C. 154(b) by 35 days.

(21) Appl. No.: 12/054,372

(22) Filed: Mar. 24, 2008

Related U.S. Application Data

(60) Provisional application No. 60/896,786, filed on Mar. 23, 2007.

(51) Int. Cl.
*E21B 31/06* (2006.01)

(52) U.S. Cl. ..... 166/311; 166/66.5

(58) Field of Classification Search ..... 166/311, 166/312, 66.5, 99
See application file for complete search history.

(56) References Cited

U.S. PATENT DOCUMENTS 2,556,849 A * 6/1951 Nolley et al. ..... 166/66.5
2,819,038 A 1/1958 Eckel
2,834,300 A 5/1958 Brock
2,894,725 A 7/1959 Baker
3,089,724 A 5/1963 Crooks
4,059,155 A * 11/1977 Greer ..... 166/301
4,084,636 A * 4/1978 Burge ..... 166/66.5
4,111,262 A 9/1978 Duncan
5,944,100 A * 8/1999 Hipp ..... 166/99
6,176,311 B1 1/2001 Ryan
6,951,251 B2 10/2005 Penisson
7,219,724 B2 * 5/2007 Theriot, Sr. ..... 166/66.5

* cited by examiner

*Primary Examiner*—William P Neuder
(74) *Attorney, Agent, or Firm*—Carver, Darden, Koretzky, Tessier, Finn, Blossman & Areaux, LLC; Raymond G. Areaux; Lisa Velez

(57) ABSTRACT

An autonomous magnetic sleeve for a riser is provided. The sleeve is constructed and arranged to be independently lowered and seated above a subsea tree section. The autonomous magnetic sleeve includes a cylindrical structure having an inner diameter larger than a diameter of the wellbore and is seated on a riser seat when deployed. The cylindrical structure has affixed thereto a plurality of magnetic assemblies space circumferentially around an interior surface of the cylindrical structure.

33 Claims, 5 Drawing Sheets

(PLANE B-B)

(PLANE C-C)

AUTONOMOUS MAGNETIC SLEEVE FOR A RISER

CROSS-REFERENCE TO RELATED APPLICATIONS

The present application claims priority from U.S. Provisional Application No. 60/896,786, filed Mar. 23, 2007, which is incorporated herein by reference as if set forth in full below.

BACKGROUND OF THE INVENTION

I. Field

The present invention relates to an oilfield tool and more particularly, to an autonomous magnetic sleeve for a riser which is constructed and arranged to be independently lowered and seated above a subsea tree to capture ferromagnetic materials in the drilling fluid flowing into the riser.

II. Background

Various types of junk baskets have been devised for collecting debris from a wellbore during a cleaning operation. The junk basket has a basket dimensioned to collect debris flowing around and external to the basket. The top end of the junk basket is open and relies on free falling debris in the upward-flowing drilling fluid to fall into the opening of the junk basket where it remains until the junk basket is removed. However, the force of the upward-flowing drilling fluid carrying the debris impedes the collection of the debris by the junk basket.

Thus, some junk baskets are not able to collect a substantial portion of the debris in the wellbore, particularly when fluid circulates through the junk basket and upward through an annulus in the well as the basket is retrieved to the surface. Other junk baskets are complicated and are thus relatively expensive.

FIG. 1 illustrates a conventional junk basket 1 having a central mandrel 2 and a basket 4. The annulus between the wellbore 3 and the basket 4 narrows. Thus, the upward-flowing fluid, denoted by ARROW A, has a first speed. The fluid, denoted by ARROW B, has a second speed faster than the first speed as a result of the narrower annulus. The fluid, denoted by ARROW C, continues upward toward the top of the wellbore 3 and is generally slower than the fluid, denoted by ARROW B. However, as the fluid, denoted by ARROW B, passes the upper end of the basket 4, a portion of the fluid automatically travels, in the direction of ARROW E, toward the central mandrel 2 as the annulus is abruptly enlarged. This portion of the fluid flowing in the direction denoted by ARROW E forms small eddy currents created directly over the opening in the basket 4. However, simultaneously, fluid flowing upward, in the direction of ARROW C, recaptures or carries away the debris. Thus, the deposit of debris in the basket 4 is impeded.

Most junk baskets are positioned at various locations in a work string. However, a significant amount of debris is still carried up to the top of the wellbore. The floating debris must be retrieved and removed from the drilling fluid. However, there is not an efficient or quick means of removing the debris near the top of the wellbore. The slower moving fluid in the riser may not be able to suspend the heavier debris. Thus, the heavier debris floats downward.

There are also a variety of magnetic devices for use in the wellbore. These devices are also installed at various locations in the wellbore. However, a significant amount of ferromagnetic materials remains uncaptured as the fluid enters the riser.

Thus, there is a continuing need for an autonomous magnetic sleeve for use in a riser which is constructed and arranged to be independently lowered and seated above a subsea tree to capture ferromagnetic materials in the drilling fluid flowing into the riser.

SUMMARY OF THE INVENTION

The present invention contemplates an autonomous magnetic sleeve for use in a riser comprising a cylindrical structure having an outer diameter larger than an inner diameter of a wellbore and smaller than an inner diameter of the riser. The cylindrical structure also has a hollow throughbore center, the hollow throughbore center having an inner diameter greater than an outer diameter of a work string for the wellbore. The sleeve also includes a plurality of magnetic assemblies spaced circumferentially around and affixed to an interior surface of the cylindrical structure to capture ferromagnetic material flowing up through the hollow throughbore center from the wellbore.

The present invention further contemplates an autonomous magnetic sleeve for use in a riser wherein each magnetic assembly comprises a plurality of magnets, a magnet housing operable to seal the plurality of magnets therein, and at least one non-magnetic spacer is placed between adjacent magnets housed within the magnet housing wherein the ferromagnetic material collects on the magnet housing automatically by magnetic attraction.

The present invention further contemplates an autonomous magnetic sleeve for use in a riser wherein the magnet or magnets housed within the magnet housing are aligned such that the opposing magnetic poles are oriented tangentially with the circumference of the sleeve.

The present invention further contemplates an autonomous magnetic sleeve for use in a riser wherein the interior surface of the cylindrical structure is a debris collection area comprising at least one magnet assembly and a secondary collection area adjacent to said at least one magnet assembly wherein the ferromagnetic material collects on the debris collection area automatically by magnetic attraction.

The present invention further contemplates an autonomous magnetic sleeve for a riser comprising a free-standing rigid structure having an outer diameter larger than an inner diameter of a wellbore and smaller than an inner diameter of the riser. The free standing structure has a hollow throughbore center, the hollow throughbore center having an inner diameter greater than an outer diameter of a work string for the wellbore. The sleeve includes means, coupled to an interior surface of the free standing structure within the hollow throughbore center, for magnetically attracting ferromagnetic material flowing up through the hollow throughbore center.

An advantage of the autonomous magnetic sleeve is its autonomy from the work string. Thus, the autonomous magnetic sleeve may be lowered and raised from the riser independent of the work string.

A further advantage of the autonomous magnetic sleeve is the increase area to capture ferromagnetic materials and to collect larger amounts of ferrous debris, including heavy and larger size ferromagnetic materials, suspended in the riser.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals.

Figure 1:
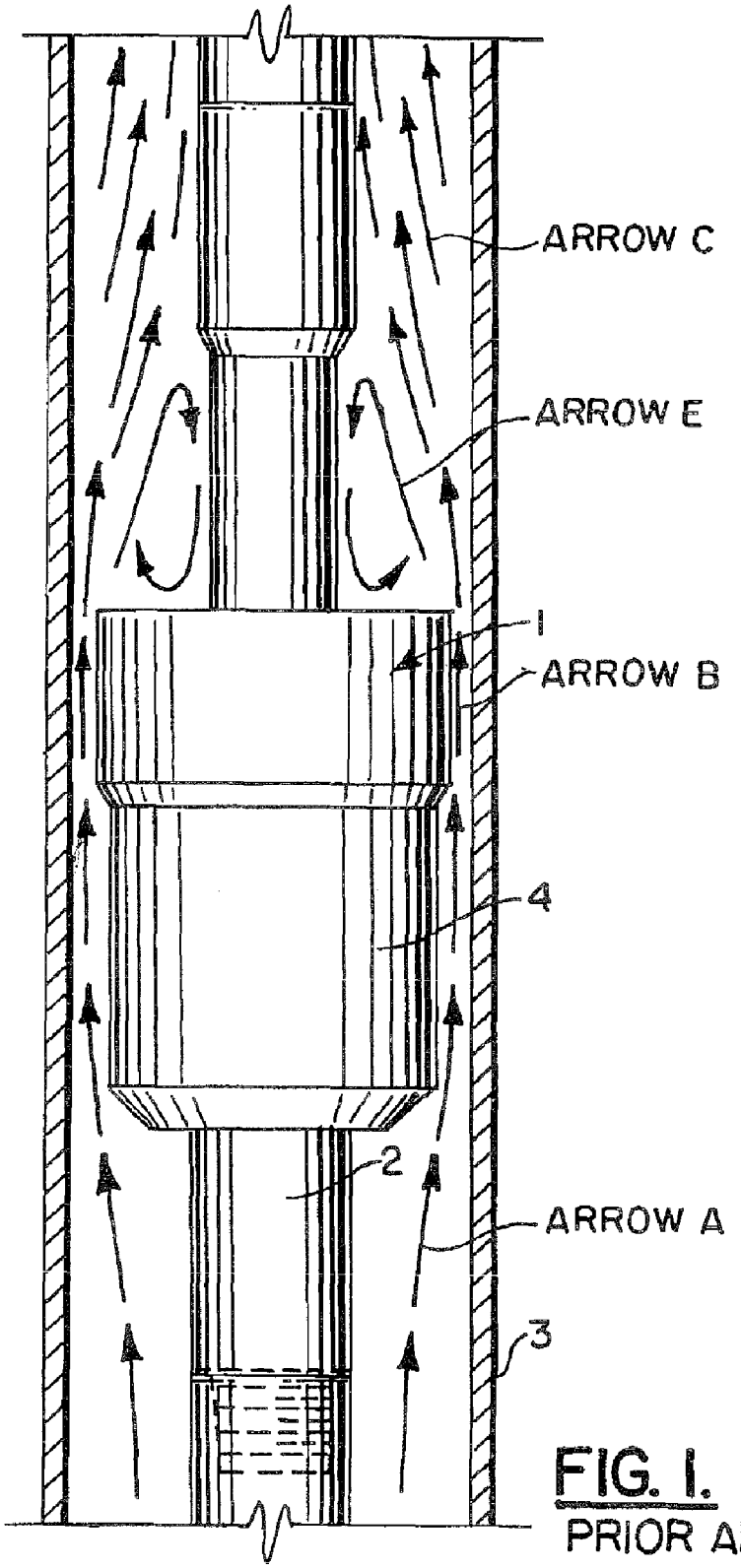
FIG. 1. PRIOR ART
FIG. 1 illustrates a conventional junk basket installed in a wellbore below a riser.

The images in the drawings are simplified for illustrative purposes and are not depicted to scale. To facilitate understanding, identical reference numerals have been used, where possible, to designate identical elements that are common to the Figures, except that suffixes may be added, when appropriate, to differentiate such elements.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION

Referring now to the drawings and particularly FIGS. 2-6, an autonomous magnetic sleeve is designated by the reference numeral 10. The autonomous magnetic sleeve 10 is operable to be positioned in a riser 16, such as defined by the interior surface 14 of the riser 16, to capture ferromagnetic debris from a wellbore 12 such as during cleaning operations. The riser 16 is followed by a subsea tree section 22. The subsea tree section 22 is followed by the casing wall 24 of the wellbore 12.

Ferromagnetic materials are those materials that are attracted by a magnetic force, such as, without limitation, iron, nickel, cobalt, gadolinium, iron alloys and steel.

Wellbores are typically cleaned after a hole is drilled and the casing wall 24 is set in place. In order to save time and money, operators generally prefer to run the cleaning work string 26 into the wellbore 12 just once if possible. It usually takes one to four days to clean a wellbore 12 of leftover drilling fluids, cement bits, iron debris, other ferromagnetic material and caked deposits on the casing wall 24. Wells having risers (generally a temporary tube connecting the surface drilling operation to the sea floor which is typically a few hundred feet to several thousand feet long) are usually cleaned in two operations. In a first cleaning operation, a short string is used to clean from an upper surface to the subsea tree section 22. In a second cleaning operation, a long string is generally used to clean from the subsea tree section 22 to the wellbore depth. Very high fluid flow rates can be used to clean the riser 16 during the first cleaning operation. In one aspect, the autonomous magnetic sleeve 10 may be used after the riser 16 is cleaned because it may be most efficient in trapping ferromagnetic debris coming up from the wellbore 12. Furthermore, the autonomous magnetic sleeve 10 may be used in the riser 16 to collect ferromagnetic debris until the clean up operations are complete.

Figure 5:
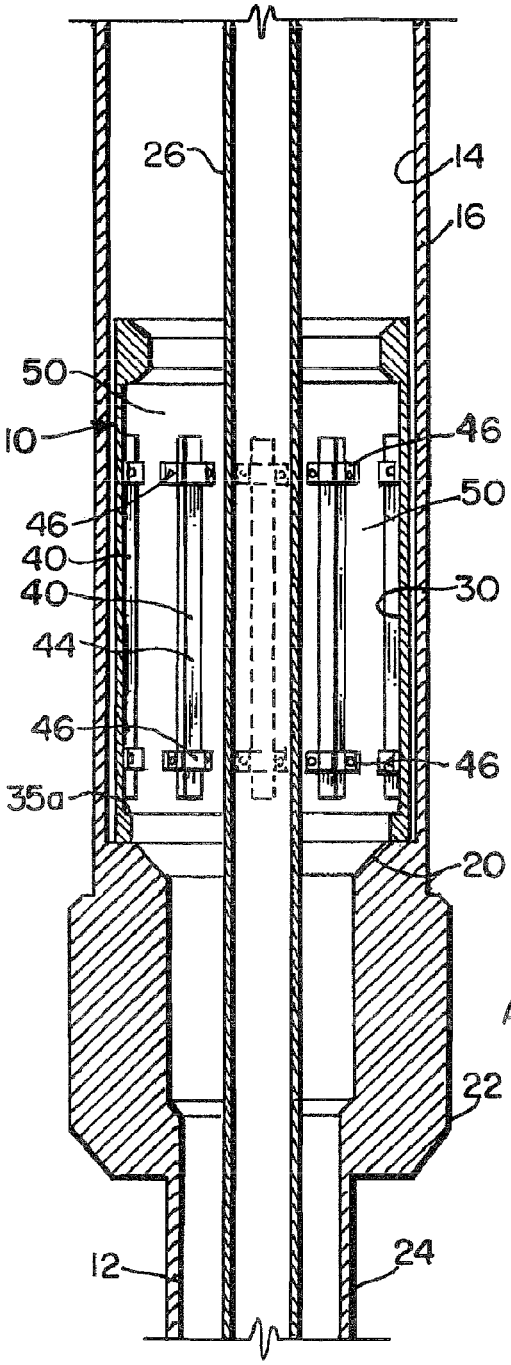
FIG. 5 illustrates a cross-sectional view of the autonomous magnetic sleeve installed in a riser above a subsea tree section in accordance with the present invention.
Figure 6:
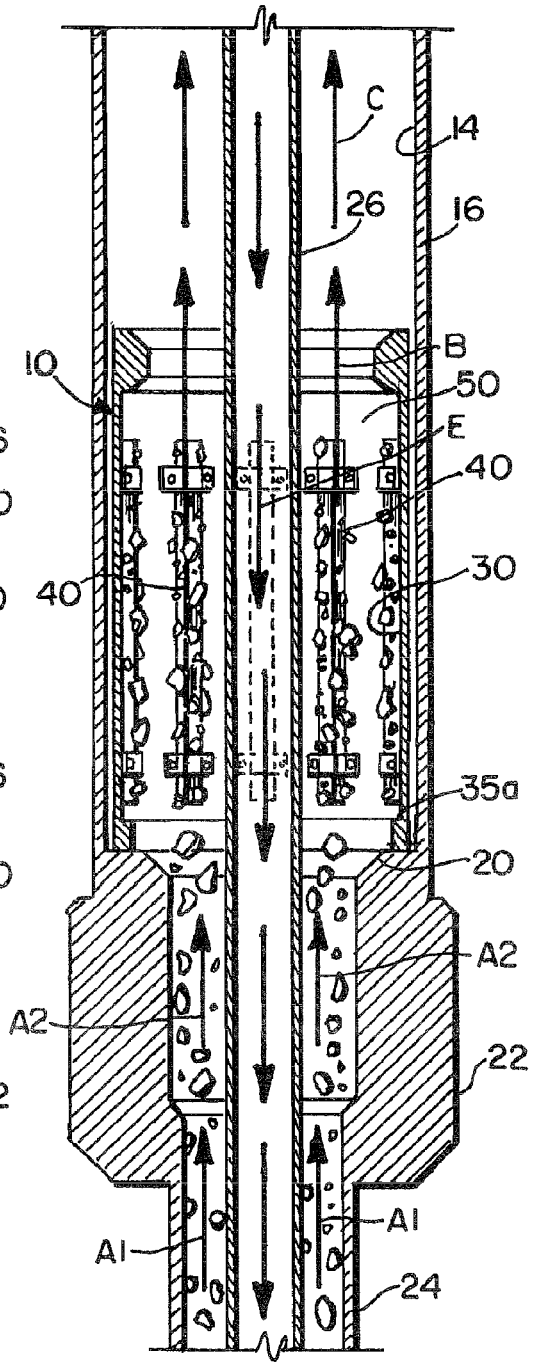
FIG. 6 illustrates a cross-sectional view of the autonomous magnetic sleeve installed in a riser above a subsea tree section in accordance with the present invention with debris captured.

During cleaning operations, a work string 26 is lowered downhole in the wellbore 12 for cleaning operations. The interior surface of the casing wall 24 may be in fluid communication with a hydrocarbon formation. As best seen in FIGS. 5 and 6, the riser 16 has an inner diameter ID which is larger than the ID of the subsea tree section 22 and/or the casing wall 24. The transition between a larger riser ID to a smaller subsea tree ID creates a riser seat 20. In one configuration, the transition between the larger riser ID to the smaller subsea tree ID is sloped or resembles a funnel. The subsea tree section 22 may have one or more sub-sections with varying IDs one of which may be dimensioned to coincide with the ID of the casing wall 24 immediately below the subsea tree section 22.

In general, the autonomous magnetic sleeve 10 is constructed and arranged to be independently lowered and seated above the subsea tree section 22 on the riser seat 20 and, subsequently, raised and removed independently of the work string 26. For example, the magnetic sleeve 10 may be fished from the riser 16. Alternately, the magnetic sleeve 10 may be raised with the work string 26. The autonomous magnetic sleeve 10 may be comprised of tough steel that may be easily welded, such as 4130.

Figure 3:
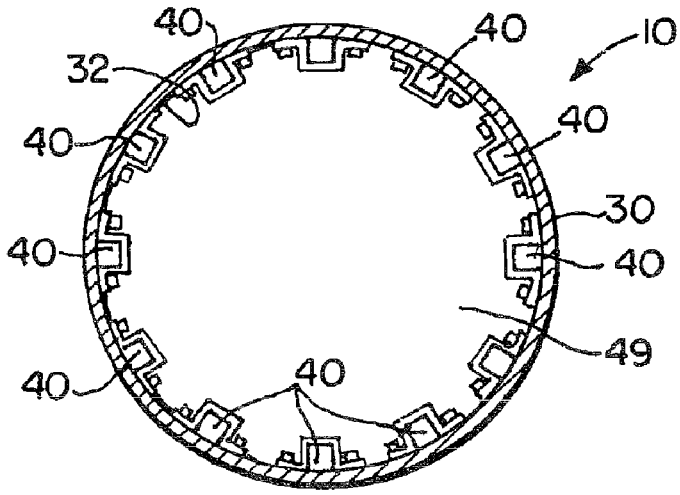
FIG. 3 illustrates an end view of the autonomous magnetic sleeve of FIG. 2.
Figure 2:
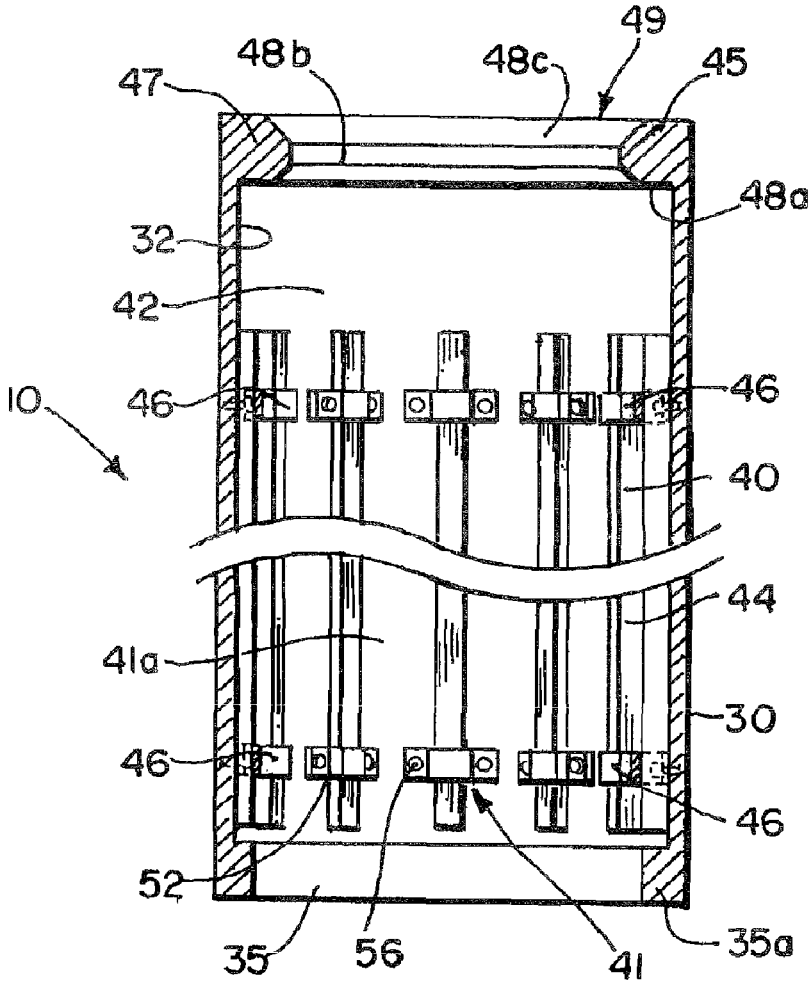
FIG. 2 illustrates a cross sectional view of an autonomous magnetic sleeve in accordance with the present invention.
Figure 4:
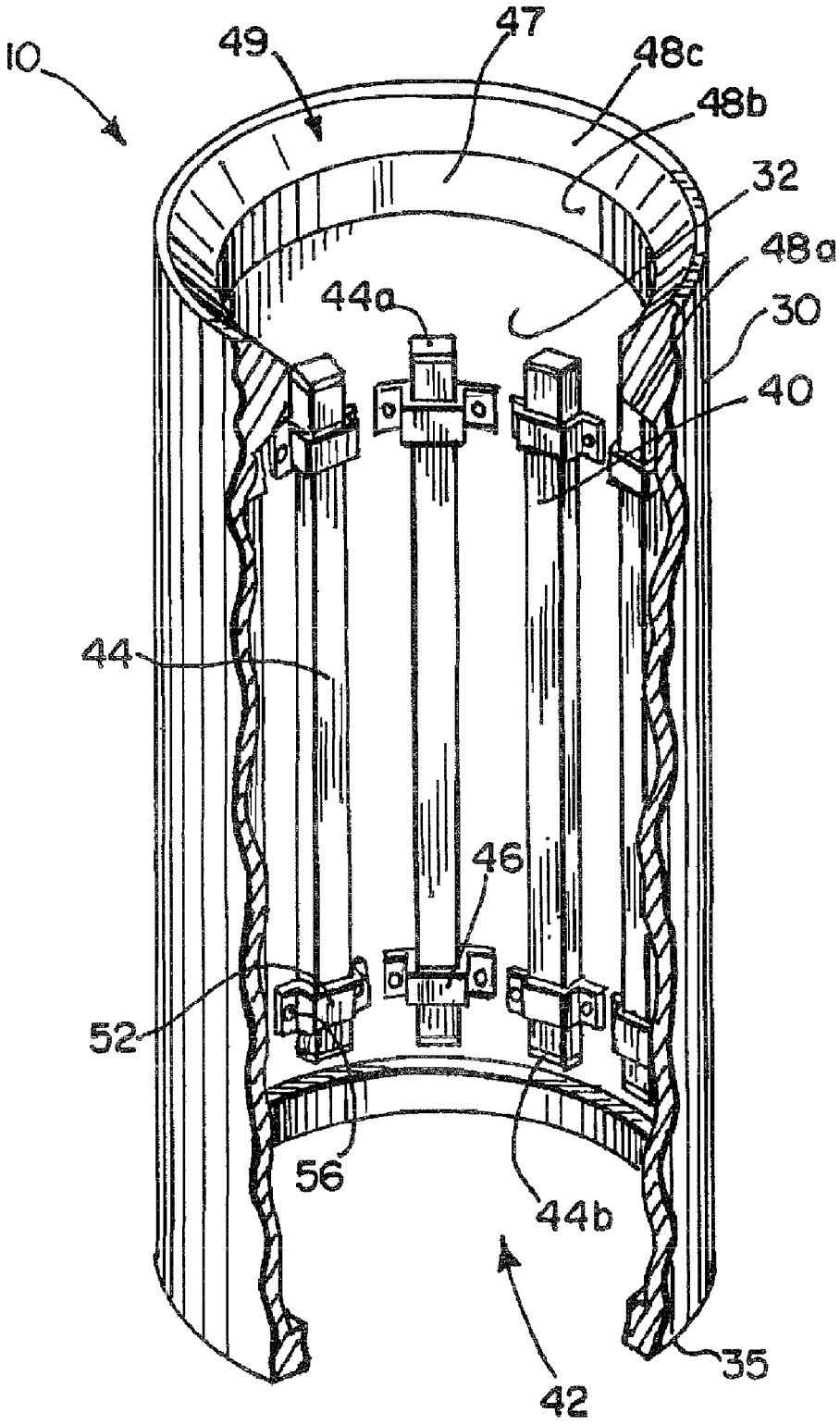
FIG. 4 illustrates a perspective view of an autonomous magnetic sleeve in accordance with the present invention with a portion removed.

FIG. 4 illustrates a perspective view of an autonomous magnetic sleeve 10 with a portion removed. FIG. 3 illustrates an end view of the autonomous magnetic sleeve 10. The autonomous magnetic sleeve 10 comprises in general a cylindrical structure 30 having attached to an inner cylindrical surface 32 thereof a plurality of magnet assemblies 40. The plurality of magnet assemblies 40 line the inner cylindrical surface 32 to create a ferromagnetic collecting area 41 to magnetically adhere debris thereto. Ferromagnetic collecting area 41 includes both the magnet assemblies 40 and any portion of inner cylindrical surface 32 between magnet assemblies, said portion being secondary collection area 41*a*. The cylindrical structure 30 is made of rigid material and is a free standing structure, and is preferably ferromagnetic itself.

The larger diameter of the riser 16 enables the area of the collecting area 41 to be increased over other magnetic collecting devices dimensioned for use in the casing wall 24 below the subsea tree 22. Thus, the magnetic sleeve 10 also allows the larger size and/or heavier ferrous debris to be collected near the bottom of the riser 16. Furthermore, the outer diameter OD of the cylindrical structure 30 is slightly smaller than the ID of the riser 16 to provide sufficient clearance between the cylindrical structure 30 and the interior surface 14 of the riser 16 so that the sleeve 10 may be installed and removed without hindrance. The longitudinal center of the cylindrical structure 30 is hollow. Thus, the cylindrical structure 30 creates a central hollow throughbore section 42.

The cylindrical structure 30 further includes a top side or edge 45 having brim 47. The brim 47 narrows the opening 49 at the top side or edge 45 of the cylindrical structure 30. The opening 49 has an ID which is larger than the OD of a work string 26. The brim 47 is also constructed and arranged to allow the autonomous magnetic sleeve 10 to be lowered to and fished out from the riser independently of the work string 26. The brim 47 may serve as a fish neck for attachment of a tool to lower, set and retrieve the sleeve 10.

In one configuration, the brim 47 is a solid structure contoured with a lower edge 48*a* extending a small distance from the inner surface of the cylindrical structure 30. The distal end of the lower edge 48*a* away from the cylindrical structure 30 curves or transitions upward and becomes essentially vertical to form a vertical surface 48*b* (curving in the direction toward the upper distal end of the cylindrical structure 30). An upper portion 48*c* of the vertical surface 48*b* tapers, slopes or flares slightly back toward the cylindrical structure 30 such that the ID of the opening 49 is slightly flared or increased. The upper portion 48*c* is sloped in a direction to promote feeding the reverse fluid out of opening 49 in the direction of ARROW C. The brim 47 may be used as a guide.

The bottom end 35 of the cylindrical structure 30 provides both an inlet and an outlet. The bottom end 35 has a lip 35*a*. In one configuration the lip 35*a* reduces the bottom end 35 to rest the cylindrical structure 30 on the riser seat 20. For example, as the work string 26 is lowered downhole, the work string 26 passes through and in opening 49 and, subsequently, out of the bottom end 35. Also, reverse fluid traveling upward to the top of the riser 16 in the direction of ARROWS A1 and A2, travels up through the bottom end 35 and into the central hollow throughbore section 42, in the direction of ARROW B.

An annulus 50 (FIGS. 5 and 6) is defined between work string 26 and the inner cylindrical surface 32 of the cylindrical structure 30. The plurality of magnet assemblies 40 are spaced circumferentially around the inner cylindrical surface 32. In one aspect, the magnetic assemblies 40 including an elongated tubular housing 44 adapted to be mounted or affixed via fasteners 46 to the inner cylindrical surface 32. In one configuration, the fasteners 46 include brackets 52 which strap upper and lower ends of the elongated tubular housing 44 to the inner cylindrical surface 32. The brackets 52 may be bolted via bolts 56 to the inner cylindrical surface 32. Hence in one configuration, the plurality of magnetic assemblies 40 are individually removable and replaceable. Nevertheless, the elongated housing 44 may be permanently affixed such as by welding.

Figure 7B:
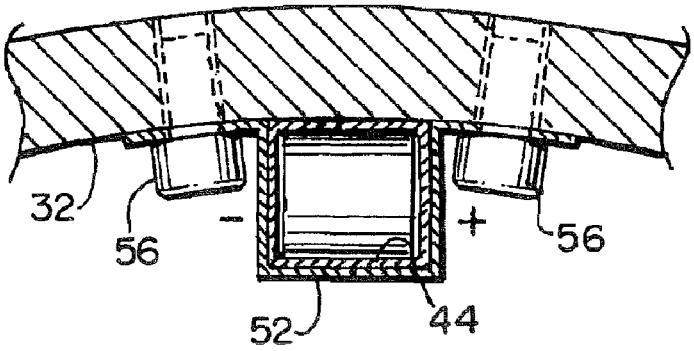
FIG. 7B illustrates a cross-sectional view of the magnetic assembly of FIG. 7A.
Figure 7A:
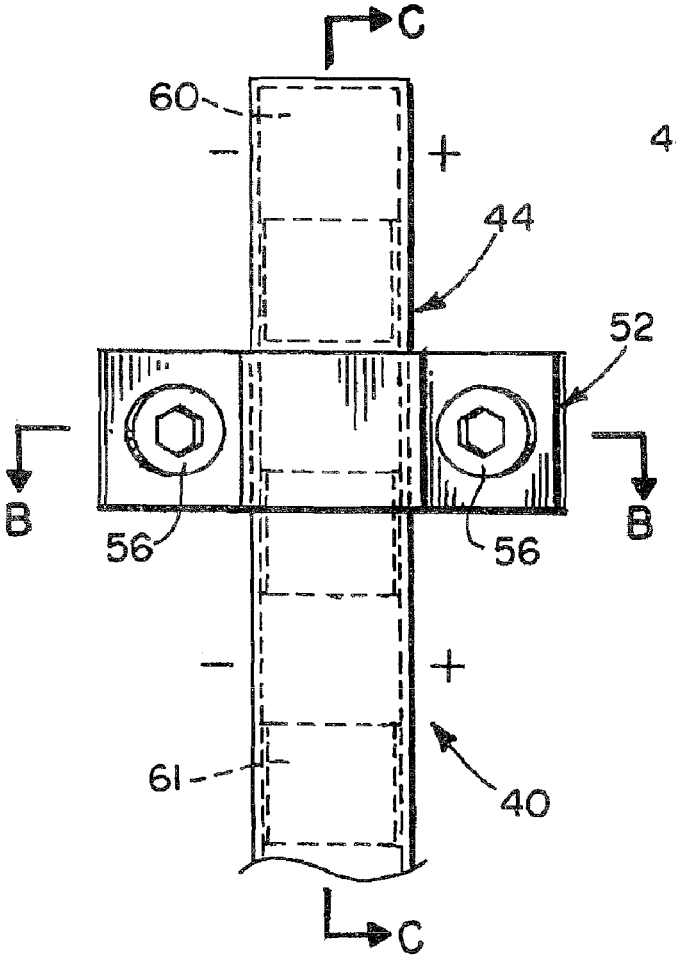
FIG. 7A illustrates a portion of a magnetic assembly, including a restraining bracket.
Figure 7C:
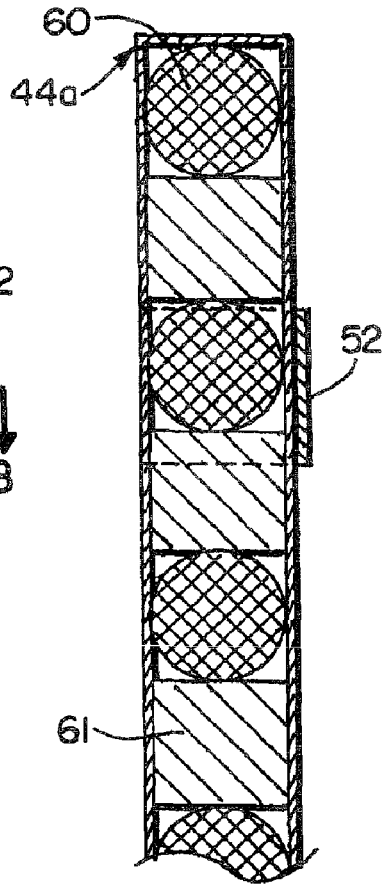
FIG. 7C illustrates a different cross-section view of the magnetic assembly of FIG. 7A, including a cross-sectional view of the magnets housed within said magnetic assembly.

The elongated tubular housing 44 houses therein one or more magnets 60 (FIGS. 7A and 7C). The polarity of the magnet or magnets 60 may be alternate in polarity from one magnetic assembly to another. For example, adjacent magnetic assemblies 40 may be alternately polarized. Note that a single magnet or a series of smaller individual magnets may be used. Further, an alternate embodiment could include a magnet assembly which allows the magnets to be exposed to the environment thereby allowing collection of ferromagnetic debris directly on the magnet surface.

In yet another configuration, half of a given magnet body may be polarized for one polarity and the other side of said magnet body polarized to the opposite polarity, and the magnets may be aligned such that the opposing poles are oriented tangentially with respect to the circumference of magnetic sleeve 10 (FIGS. 3 and 7A-7C). In a still further configuration, each magnet 60 may be separated from the next magnet 60 within a given tubular housing 44 by a non-magnetic spacer 61 (FIG. 7C). The magnets may be neodymium magnets. Any shape magnet or spacer may be used.

The elongated tubular housing 44 is intended to be sealed. Thus, top or bottom end caps 44*a* and 44*b* may be welded to close off and seal the magnets 60 in the housing 44 from the drilling fluid.

In one mode of operation, to install the autonomous magnetic sleeve 10, the sleeve 10 is lowered to the bottom of riser 16 to rest on riser seat 20. A work string 26 may be installed downhole in the wellbore 12. Fluid flows downward in the direction of ARROWS E in the throughbore of the work string 26. During cleaning operations, the fluid flowing in the direction of ARROWS E are emitted into the wellbore 12. The fluid carries debris in a reverse flow up to the top of the wellbore 12 and into the riser 16. This fluid passes into the annulus 50 where ferromagnetic material is automatically captured by the plurality of magnets 40.

After a predetermined period or at the end of a cleaning cycle, the autonomous magnetic sleeve 10 is fished from the bottom of the riser 16 so that the ferromagnetic material may be removed.

In one aspect, the autonomous magnetic sleeve 10 remains in the riser 16 until cleaning operations are complete. In another aspect, the autonomous magnetic sleeve 10 may be deployed, raised and re-deployed with or without the work string 26 downhole.

The wellbore cleaning operation preferably entails additional cleaning tools for liberating debris within the wellbore 12 such as may be accumulated along the interior surface of the casing wall 24. For example, a brush or scraper type tool may be positioned along the upper string, and/or a hydraulically powered jetting or circulating tool positioned below the junk basket.

During the wellbore cleaning operation, the cleaning tools may be used to liberate debris prior to and/or concurrently with passing fluid through the work string 26, then upward through the casing wall past the subsea tree section 22 and into the riser 16. Fluid is thus passed from the work string 26, downward through its center into the wellbore 12. Fluid passing into the wellbore 12 may gather and carry ferromagnetic material (debris) present within the wellbore 12. The fluid passes from the wellbore 12 upward to the riser 16 and through the annulus 50, possibly carrying with it ferromagnetic material (debris) from the wellbore 12.

Upon completion of the wellbore cleaning operation or drilling operations, the work string 26 may be moved upward from the wellbore 12. The autonomous magnetic sleeve 10 may then be cleaned of the ferromagnetic material and used again in subsequent wellbore cleaning operations.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

What is claimed is:

1. An autonomous magnetic sleeve for a riser comprising:

a cylindrical structure having an outer diameter larger than an inner diameter of a wellbore and smaller than an inner diameter of the riser and having a hollow throughbore center, the hollow throughbore center having an inner diameter greater than an outer diameter of a work string for the wellbore; and a plurality of magnetic assemblies spaced circumferentially around and affixed to an interior surface of the cylindrical structure to capture ferromagnetic material flowing through the hollow throughbore center from the wellbore.

2. The sleeve according to claim 1, wherein the cylindrical structure comprises, at a top end, a brim operable to attach a tool thereto to lower and retrieve the sleeve.

3. The sleeve according to claim 1, wherein the hollow throughbore center has an inner diameter along an entire longitudinal axis of the cylindrical structure that is greater than the outer diameter of the work string and is adapted to be autonomous to the work string.

4. The sleeve according to claim 1, wherein the sleeve is operable to be seated at a bottom of the riser and supported at a riser seat above a subsea tree section.

5. The sleeve according to claim 1, wherein each of the plurality of magnetic assemblies comprises:

at least one magnet producing at least one magnetic force; and a magnet housing operable to seal the at least one magnet therein wherein the ferromagnetic material collects on the magnet housing automatically by magnetic attraction.

6. The sleeve according to claim 1, wherein each of the plurality of magnetic assemblies comprises:

at least one magnet;

a magnet housing operable to seal the at least one magnetic therein; and fasteners operable to affix the magnet housing to the interior surface of the cylindrical structure.

7. The sleeve according to claim 6, wherein the at least one magnet comprises a first set of magnets having a first polarity and a second set of magnets having a second polarity opposite the first polarity.

8. The sleeve according to claim 6, wherein the fasteners comprise brackets for removably coupling the magnet housing to the cylindrical structure.

9. The sleeve according to claim 1, wherein the sleeve is free standing in the riser.

10. The sleeve according to claim 1, wherein each of the plurality of magnetic assemblies comprises:

at least one magnet; and fasteners operable to affix said magnet to the interior surface of the cylindrical structure wherein the ferromagnetic material collects on the magnet automatically by magnetic attraction.

11. The sleeve according to claim 1, wherein each of the plurality of magnetic assemblies comprise:

a plurality of magnets;

a magnet housing operable to seal the plurality of magnets therein; and at least one non-magnetic spacer placed between adjacent magnets housed within the magnet housing wherein the ferromagnetic material collects on the magnet housing automatically by magnetic attraction.

12. The sleeve according to claim 11, wherein each of the plurality of magnets is aligned such that the opposing magnetic poles are oriented tangentially with the circumference of the sleeve.

13. The sleeve according to claim 1, wherein the interior surface of the cylindrical structure is a debris collection area comprising:

at least one magnet assembly; and a secondary collection area adjacent to said at least one magnet assembly wherein the ferromagnetic material collects on the debris collection area automatically by magnetic attraction.

14. An autonomous magnetic sleeve for a riser comprising:

a free standing rigid structure having an outer diameter larger than an inner diameter of a wellbore and smaller than an inner diameter of the riser and having a hollow throughbore center, the hollow throughbore center having an inner diameter greater than an outer diameter of a work string for the wellbore; and means, coupled to an interior surface of the free standing structure within the hollow throughbore center, for magnetically attracting ferromagnetic material flowing through the hollow throughbore center.

15. The sleeve according to claim 14, wherein the free standing structure comprises, at a top end, a brim operable to attach a tool thereto to lower and retrieve the sleeve.

16. The sleeve according to claim 14, wherein the hollow throughbore center has an inner diameter along an entire longitudinal axis of the free standing structure that is greater than the outer diameter of the work string and is adapted to be autonomous to the work string.

17. The sleeve according to claim 15, wherein the free standing structure comprises a cylindrically shaped structure with the hollow throughbore center.

18. The sleeve according to claim 14, wherein the sleeve is operable to be seated at a bottom of the riser and cradled in a riser seat above a subsea tree section.

19. The sleeve according to claim 14, wherein the magnetically attracting means comprises a plurality of magnetic assemblies spaced circumferentially around an interior surface.

20. The sleeve according to claim 19, wherein each of the plurality of magnetic assemblies comprises:

means for producing at least one magnetic force; and means for housing the magnet force producing means wherein the ferromagnetic material collects on the housing means automatically by magnetic attraction.

21. The sleeve according to claim 19, wherein each of the plurality of magnetic assemblies comprises:

means for producing at least one magnetic force;

means for housing the magnet force producing means wherein the ferromagnetic material collects on the housing means automatically by magnetic attraction; and means for fastening the housing means to the interior surface.

22. The sleeve according to claim 21, wherein the magnetic force producing means comprises a first set of magnets having a first polarity and a second set of magnets having a second polarity opposite the first polarity.

23. The sleeve according to claim 21, wherein the free standing structure is autonomous to the riser and work string.

24. The sleeve according to claim 19, wherein each of the plurality of magnetic assemblies comprises:

means for producing at least one magnetic force; and means for fastening the magnetic force producing means to the interior surface wherein the ferromagnetic material collects on the magnetic force producing means automatically by magnetic attraction.

25. The sleeve according to claim 20, wherein each of the plurality of magnetic assemblies comprises:

a plurality of magnets; and means for separating adjacent magnets contained within the housing means.

26. The sleeve according to claim 25, wherein the separating means comprises non-magnetic spacers.

27. A method of cleaning a wellbore comprising:

cleaning a riser from an upper surface to a subsea tree section;

lowering an autonomous magnetic sleeve to a seat of the riser;

installing a work string through the riser and the autonomous magnetic sleeve to a depth of the wellbore, the work string being independent of the sleeve;

cleaning a wellbore with the work string; and capturing ferromagnetic debris from the wellbore within the autonomous magnetic sleeve, simultaneously with the cleaning of the wellbore.

28. The method according to claim 27, further including, during cleaning of the riser, employing very high fluid flow rates in the riser.

29. The method according to claim 27, further including, during the cleaning of the wellbore, moving the work string; and further comprising maintaining the autonomous magnetic sleeve stationary at the seat of the riser, during moving of the work string.

30. The method according to claim 27, wherein the capturing of the ferromagnetic debris includes automatically attracting the ferromagnetic debris flowing in a drilling fluid circulating up from the wellbore.

31. The method according to claim 27, during the capturing of the ferromagnetic debris, the method includes:

channeling the drilling fluid through an annulus between the work string and a hollow throughbore center of the autonomous magnetic sleeve; and automatically attracting the ferromagnetic debris to the autonomous magnetic sleeve directly from the annulus.

32. The method according to claim 27, further comprising:

fishing the autonomous magnetic sleeve from the riser.

33. The method according to claim 32, wherein the fishing comprises:

fishing the autonomous magnetic sleeve from the riser after the cleaning of the wellbore is complete.

* * * * *